US010907881B2

(12) United States Patent
Boyles

(10) Patent No.: US 10,907,881 B2
(45) Date of Patent: Feb. 2, 2021

(54) MECHANICAL SNOW AND ICE REMOVAL FOR IMPINGER

(71) Applicant: Messer Industries USA, Inc., Bridgewater, NJ (US)

(72) Inventor: Scott Boyles, Telford, PA (US)

(73) Assignee: Messer Industries USA, Inc., Wilmington, DE (US)

( * ) Notice: Subject to any disclaimer, the term of this patent is extended or adjusted under 35 U.S.C. 154(b) by 0 days.

(21) Appl. No.: 15/237,020

(22) Filed: Aug. 15, 2016

(65) Prior Publication Data

US 2018/0045454 A1 Feb. 15, 2018

(51) Int. Cl.

| | |
|---|---|
| ***F25D 21/06*** | (2006.01) |
| ***F25D 13/06*** | (2006.01) |
| ***F25D 3/11*** | (2006.01) |
| ***F25D 17/06*** | (2006.01) |
| ***F25D 25/04*** | (2006.01) |

(52) U.S. Cl.

CPC ..... *F25D 21/065* (2013.01); *F25D 3/11* (2013.01); *F25D 13/067* (2013.01); *F25D 17/06* (2013.01); *F25D 25/04* (2013.01)

(58) Field of Classification Search

CPC ..... F25D 3/11; F25D 21/065; F25D 25/04

See application file for complete search history.

(56) References Cited

U.S. PATENT DOCUMENTS

| | | | | |
|---|---|---|---|---|
| 5,365,752 | A | 11/1994 | Coffre | |
| 6,263,680 | B1 | 7/2001 | Newman et al. | |
| 6,434,950 | B2 | 8/2002 | Newman et al. | |
| 6,877,327 | B2 * | 4/2005 | Newman | F25D 3/11 62/374 |
| 7,296,431 | B2 * | 11/2007 | Muscato | A23B 4/064 62/380 |
| 7,810,347 | B2 | 10/2010 | McCormick et al. | |
| 2004/0099005 | A1 | 5/2004 | Newman et al. | |
| 2010/0163370 | A1 | 7/2010 | McCormick et al. | |

(Continued)

FOREIGN PATENT DOCUMENTS

| | | | |
|---|---|---|---|
| EP | 1077355 | A1 | 2/2001 |
| KR | 100764072 | B1 | 10/2009 |

OTHER PUBLICATIONS

International Search Report for PCT/US2017/042479, dated Oct. 19, 2017, Authorized Officer: Lee W. Young, 7 pages.

(Continued)

*Primary Examiner* — Christopher R Zerphey
(74) *Attorney, Agent, or Firm* — Joshua L. Cohen

(57) ABSTRACT

An impingement apparatus associated with a conveyor includes: (a) a shell supporting an impinger; and (b) a coolant delivery apparatus enclosed by the shell, the coolant delivery apparatus including a gas circulation device for directing a coolant to the impinger; the impinger including: (i) an impingement plate including openings for directing impingement jets toward the conveyor; (ii) at least one non-circular cam in mechanical communication with the at least one conveyor and rotatable when the conveyor is in motion; and (iii) at least one connector in mechanical communication with the at least one cam and the impingement plate, the connector displaceable during rotation of the at least one cam to elevate and lower the impingement plate.

14 Claims, 3 Drawing Sheets

(56) References Cited

U.S. PATENT DOCUMENTS

| | | | |
|---|---|---|---|
| 2010/0319385 | A1 | 12/2010 | Newman |
| 2012/0318884 | A1 | 12/2012 | McCormick et al. |
| 2014/0280401 | A1 | 9/2014 | Shamoun et al. |

OTHER PUBLICATIONS

Written Opinion of the International Searching Authority for PCT/US2017/042479, dated Oct. 19, 2017, Authorized Officer: Lee W. Young, 4 pages.
European Search Report for EP 16196776.5, dated May 22, 2017, 9 pages.

* cited by examiner

MECHANICAL SNOW AND ICE REMOVAL FOR IMPINGER

BACKGROUND

The present embodiments relate to apparatus for at least partially removing snow and ice from an impingement plate of an impingement apparatus.

Commercial cooling apparatus, such as commercial freezers, typically rely on the transfer of heat from an item, such as a food product, that is to be chilled or frozen by using a fan or blower. In many instances, the fan or blower is situated near a conveyer belt upon which the item is being carried. The item entering the freezer has a boundary layer of air surrounding it which insulates the item from the surrounding atmosphere. Traditional freezers have employed blowers that generate currents of cooling vapor in many directions. However, a significant portion of the cooling vapor does not contact the item, and in many instances does not contact the item in a direction transverse to the item's movement, such as in a perpendicular direction. Under these conditions, the cooling vapor which does contact the item often does not possess sufficient energy to substantially reduce the thickness of the boundary layer at or around the surface of the item. Therefore, there has been a need to generate directed jets of cooling vapor to disturb the boundary layer and increase heat transfer.

Previous attempts to generate directed jets of cooling vapor to the item have included using a plurality of vertical tubes to provide a unidirectional air flow toward the item, and the use of a plurality of nozzles along the pathway of an item for delivering discrete jets of unidirectional cooling air. However, the use of tubes or nozzles to direct air in a cooling or freezing device has met with only limited success due to the build-up of condensation in the form of snow and/or ice in the tubes or nozzles. Such build up quickly reduces the efficacy of the cooling or freezing devices.

Another previous attempt included heating or cooling an item on a moving substrate in which a continuous channel traversing at least a major portion of the width of the moving substrate converts multi-directional flow into unidirectional flow. However, this attempt suffers from having such an increased rate of flow that the items become entrained in the flow, and, consequently, controlled processing of the item through the device becomes difficult.

Increasing the velocity of the stream of cooling vapor (such as a cryogen) which impinges the item will increase the average heat transfer coefficient in a linear manner. At a certain point, however, unless the impingement stream of cooling vapor is carefully controlled, the velocity may also be sufficient to damage the item, or to carry the item off the conveyor, and into undesirable locations elsewhere in the freezer.

The total heat transfer rates are dependent on local heat transfer coefficients. That is, the amount of heat transferred from the items to the coolant is dependent on the rate of heat transfer locally between the coolant and the item. Local heat transfer rates can be changed by controlling the distance from the source of impingement stream to the item, the velocity of the impingement stream, the turbulence in the impingement stream, and the efficiency of the flow of coolant for the impingement stream.

Heat transfer and coolant flow may be adequately controlled by using an impingement hood comprising an impingement plate having holes to direct the flow of coolant. However, snow and ice may build up on the impingement plate, thereby reducing the efficiency of heat transfer provided by the impingement hood.

What is needed is a means by which snow and ice may be at least partially removed from an impingement plate without the need to supply high pressure gas to a cooler/freezer apparatus.

SUMMARY

Provided is an impingement apparatus associated with a conveyor, the impingement apparatus comprising: (a) a shell supporting an impinger; and (b) a coolant delivery apparatus enclosed by the shell, the coolant delivery apparatus comprising a gas circulation device for directing a coolant to the impinger; the impinger comprising: (i) an impingement plate comprising openings for directing impingement jets toward the conveyor; (ii) at least one non-circular cam in mechanical communication with the at least one conveyor and rotatable when the conveyor is in motion; and (iii) at least one connector in mechanical communication with the at least one cam and the impingement plate, the connector displaceable during rotation of the at least one cam to elevate and lower the impingement plate.

Also provided is an apparatus for cooling or freezing items comprising: a housing comprising a ceiling, a floor and side walls defining a chamber within the housing; at least one conveyer extending into the chamber between the ceiling and the floor; and at least one impingement apparatus disposed in the chamber and above the conveyor, the impingement apparatus comprising: (a) a shell supporting an impinger; and (b) a coolant delivery apparatus enclosed within the shell, the coolant delivery apparatus comprising a gas circulation device for directing a coolant to the impinger; the impinger comprising: (i) an impingement plate comprising openings for directing impingement jets toward the conveyor; (ii) at least one non-circular cam in mechanical communication with the at least one conveyor and rotatable when the conveyor is in motion; and (iii) at least one connector in mechanical communication with the at least one cam and the impingement plate, the connector displaceable during rotation of the at least one cam to elevate and lower the impingement plate.

BRIEF DESCRIPTION OF THE DRAWINGS

The accompanying drawings are included to provide a further understanding of the apparatus and process provided herein and are incorporated in and constitute a part of this specification. The drawings illustrate embodiments of the apparatus and process provided herein and, together with the description, serve to explain the principles described herein but are not intended to limit the specification or any of the claims.

DESCRIPTION

Figure 1:
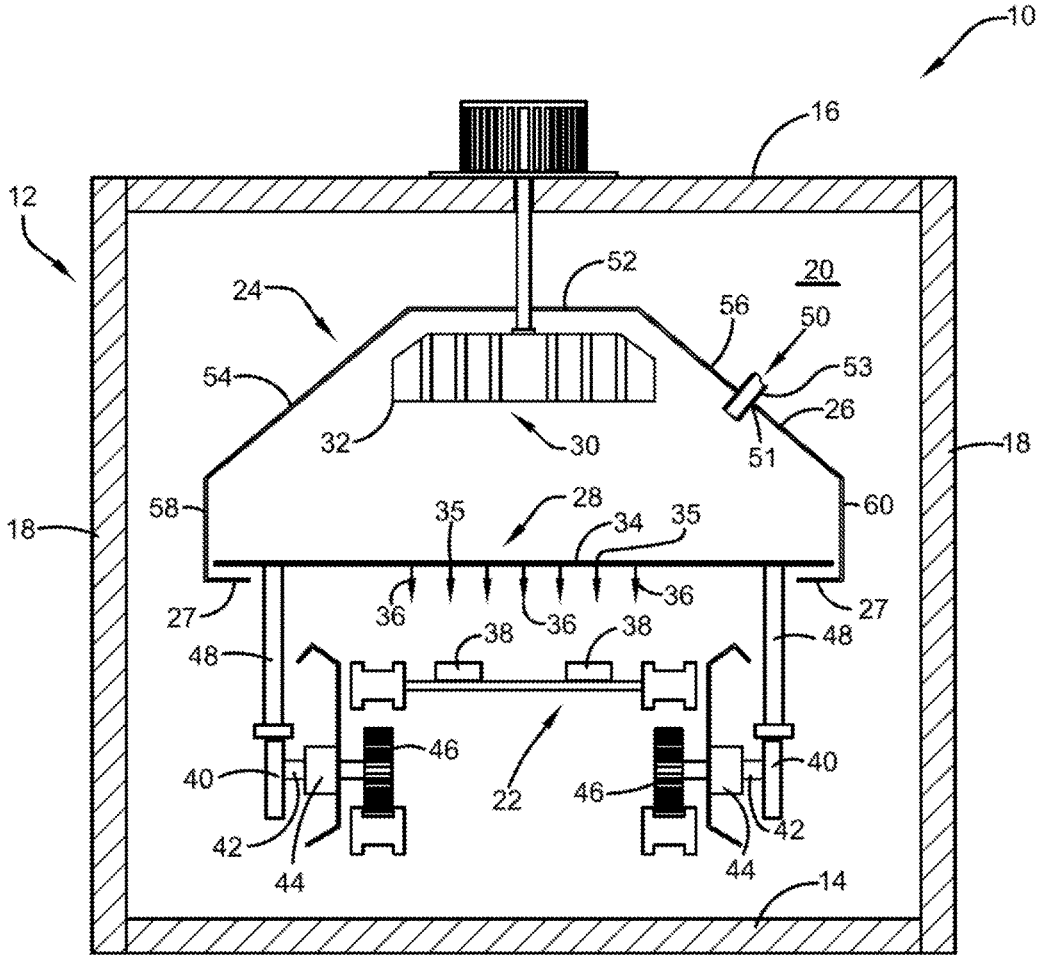
FIG. 1 is a cross-sectional view of an embodiment of an apparatus as described herein.
Figure 2:
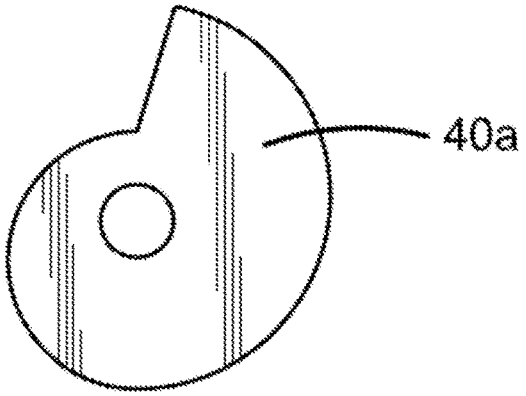
FIG. 2 is a frontal view of a first embodiment of a cam for use in an apparatus as described herein.
Figure 3:
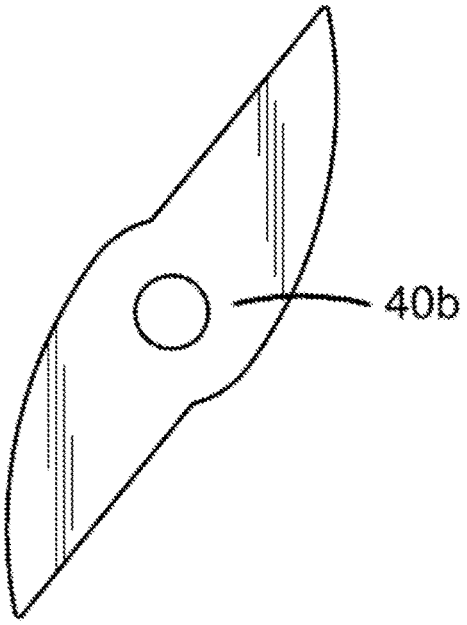
FIG. 3 is a frontal view of a second embodiment of a cam for use in an apparatus as described herein.
Figure 4:
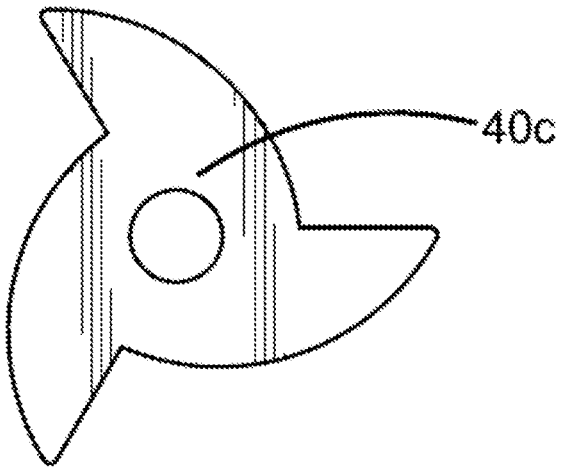
FIG. 4 is a frontal view of a third embodiment of a cam for use in an apparatus as described herein.
Figure 5:
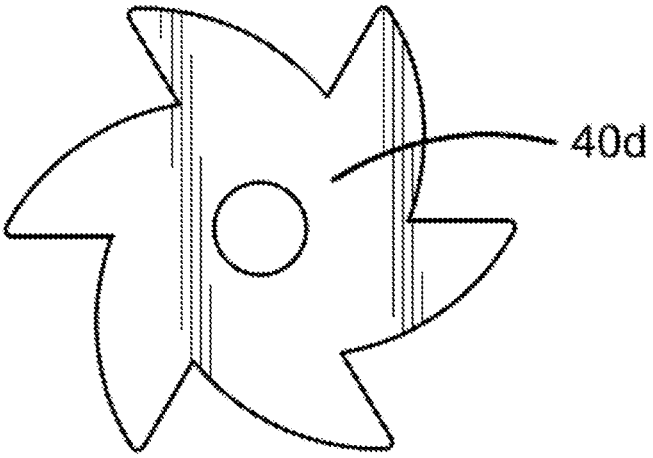
FIG. 5 is a frontal view of a fourth embodiment of a cam for use in an apparatus as described herein.

The present embodiments are directed to apparatus for cooling and/or freezing items, such as food products, in which an item is conveyed on a conveyor, such as a belt or other moving substrate, into a housing chamber in which the item is cooled or frozen due to its contact with gaseous, liquid or solid phase coolants, such as cryogens. In certain embodiments, the coolant or cryogen may comprise nitrogen or carbon dioxide. The term "cryogen" as used herein is similar to the term "coolant", and is not intended to necessarily be limited to materials which have a purely cryogenic effect, although that meaning is intended to be included in the use of "cryogen". The term "coolant" as used herein means any material which provides a cooling effect to or reduces a temperature of an item.

The heat transfer cooling or freezing of the items results generally from the impingement of a stream of cryogen vapor on the item. Additional heat transfer may also be achieved by spraying or mixing liquid or solid cryogen into the impingement jet streams of cryogenic vapor.

The transfer of heat from an item, such as a food product, to a cryogen is maximized through the use of an impingement apparatus or "hood" by which solid or liquid cryogen is sprayed into gas (such as carbon dioxide or nitrogen) circulated at the item while using an impinger, such as an impingement plate, to create a stream of cryogen. The design of the device increases the heat transferred from the item to the cryogen. The cryogen, for example solid carbon dioxide snow or nitrogen liquid, is introduced into an impinging flow of gas, wherein heat transfer occurs with respect to the gas and the item, to cool the item during impingement.

The use of the impingement hood increases the amount of heat transferred from an item to the cryogen, by facilitating and generating impingement jets capable of breaking through the thermal boundary layer of the item, but which are not capable of damaging the item. A force of the impingement jets contacting the boundary layer compromises a structural integrity of said layer in order to penetrate same.

Provided is an impinger comprising an impingement plate, at least one non-circular cam in mechanical communication with a conveyor and rotatable when the conveyer is in motion, and at least one connector in mechanical communication with the at least one cam and the impingement plate, the connector displaceable during rotation of the at least one cam to elevate and lower the impingement plate. By "in mechanical communication", what is meant is that two components are in direct or indirect contact (e.g., continuous or intermittent contact) with each other, such that motive force may be transferred from one component to the other. For example, the connector may be fixedly engaged with the impingement plate and intermittently come into contact with the at least one cam, such that the connector elevates and lowers, such as by gravity, the impingement plate as the at least one cam rotates. Alternatively, the connector may be fixedly engaged with the at least one cam and intermittently come into contact with the impingement plate as the at least one cam rotates. Furthermore, in certain embodiments, the connector may be fixedly engaged with both the at least one cam and the impingement plate.

The action of elevating and lowering the impingement plate creates a hammer effect, which vibrates the impingement plate to break up built-up snow and ice, which is then free to fall through the impingement plate, via gravity and/or differential pressure between opposing sides of the impingement plate, at least partially removing the snow and ice from the impingement plate. In certain embodiments, the impingement plate may be elevated by up to about two inches (2" or 5 cm) via the action of the at least one cam and connector.

In certain embodiments, provided is an impingement apparatus associated with a conveyor, the impingement apparatus comprising: (a) a shell supporting an impinger; and (b) a coolant delivery apparatus enclosed within the shell, the coolant delivery apparatus comprising a gas circulation device for directing a coolant to the impinger; the impinger comprising: (i) an impingement plate comprising openings for directing impingement jets toward the conveyor; (ii) at least one non-circular cam in mechanical communication with the at least one conveyor and rotatable when the conveyor is in motion; and (iii) at least one connector in mechanical communication with the at least one cam and the impingement plate, the connector displaceable during rotation of the at least one cam to elevate and lower the impingement plate.

Parts or all of the impingement apparatus may be provided as a retrofit design, which can be adapted to provide a means of mechanical vibration to the impingement plate. In certain embodiments, for example, a retro-fit package including a mechanically-vibrated impingement system as provided herein may be used to transform a freezing tunnel using an impinger with a conventional vibrator. These embodiments eliminate the need to supply high-pressure gas to such a freezing tunnel.

In certain embodiments, the at least one non-circular cam may be of various non-circular designs, and each independent cam within the apparatus may be of the same or different designs. Such a non-circular design allows the connector to elevate and lower the impingement plate. A non-circular design will result in the connector elevating and lowering the impingement plate once or a plurality of times during a single rotation of the cam. In certain embodiments, the at least one non-circular cam may comprise a plurality of lobes.

The at least one cam may be in mechanical communication via any component(s) which allow for the transfer of the linear motion of the conveyor into rotary motion of the at least one cam. For example, a sprocket may be in contact with the conveyor, such that the sprocket rotates as the conveyor passes over the sprocket. A shaft passes through the sprocket and a bushing housing, and connects with the cam, which rotates with the sprocket. Gears may be added to this assembly to coact with the assembly to allow the cam to spin faster or slower than the sprocket.

In certain embodiments, the connector may be directly or indirectly connected to either or both of the cam and the impingement plate, such that the impingement apparatus coacts with the conveyor. In certain embodiments, the connector is fixedly engaged with either or both of the cam and the impingement plate. In certain embodiments, the connector comprises a vertical plate engaged with the impingement plate, and the vertical plate rests on the cam, such that the vertical plate is elevated and lowered via the rotation of the cam.

In certain embodiments, the shell may comprise a top, opposed edges and opposed side walls supporting the impinger.

In certain embodiments, the impingement plate may comprise: a plurality of holes in the impingement plate, through which the impingement jets are directed; or open, elongated channels constructed and arranged between a plurality of rails forming the impingement plate, through which the impingement jets are directed.

In certain embodiments, the gas circulation device may be selected from the group consisting of an impeller, a blower, and an axial flow fan.

In certain embodiments, the impingement apparatus may be mounted in a food freezer.

In certain embodiments, provided is an apparatus for cooling or freezing items comprising: a housing comprising a ceiling, a floor and side walls defining a chamber within the housing; at least one conveyer extending into the chamber between the ceiling and the floor; and at least one impingement apparatus as described herein disposed in the chamber and above the conveyor.

In certain embodiments, the apparatus may further comprise a coolant supply in communication with the coolant delivery apparatus. In this embodiment, what is meant by "in communication" is that a coolant may be conveyed from the coolant supply to the coolant delivery apparatus, via direct or indirect connections between the coolant supply and the coolant delivery apparatus. Such connections may comprise conduits or other known means by which two components may be connected to deliver a coolant from one component to the other.

In certain embodiments, the apparatus may further comprise a plurality of modules within the housing chamber, each one of the plurality of modules including at least one impingement apparatus associated with the conveyor.

Also provided are processes and/or methods of at least partially removing snow and ice from an impingement plate using the impingement apparatus described herein. Further provided are processes and/or methods of cooling or freezing items using the apparatus described herein.

In particular and referring to FIG. 1, there is shown an illustrative apparatus 10 comprising a housing 12 comprising a floor 14, a ceiling 16, and side walls 18 (only two side walls are shown due to the perspective of the view; side walls may also be present to the front and/or rear of the view shown in FIG. 1). The housing 12 defines a chamber 20 therein. At least one conveyor 22 extends into the chamber 20 between the ceiling 16 and the floor 14. At least one impingement apparatus 24 is disposed above the conveyor 22 within the chamber 20. The impingement apparatus 24 comprises a shell 26 or sub-housing which supports an impinger 28 on lower edges 27 or lips of the shell 26. A coolant delivery apparatus 30 is enclosed by the shell 26, and comprises a gas circulation device 32. The impinger 28 comprises an impingement plate 34 having a plurality of openings 35 for directing impingement jets 36 onto items 38 transported on the conveyor 22. The conveyor 22 transports the products 38 from an inlet to an outlet of the chamber 20. In certain embodiments, the openings 35 may comprise holes in the impingement plate and/or open, elongated channels constructed and arranged between a plurality of rails forming the impingement plate.

At least one non-circular cam 40 (also referred to herein as "the cam 40") is in mechanical communication with the at least one conveyor 22 via a shaft 42, a bushing housing 44 and a sprocket 46, such that the cam 40 rotates when the conveyor 22 is in motion. (In the view depicted in FIG. 1, the direction of motion of the conveyor 22 is front to rear relative to the view.)

At least one connector 48 is in mechanical communication with the cam 40 and the impingement plate 34, such that, as the cam 40 rotates, the connector 48 elevates and lowers the impingement plate 34. The lowering of the impingement plate 34 contacts the impingement plate 34 with the lower edges 27 to thereby create an impact force to dislodge any accumulated snow and ice on the impingement plate 34. The apparatus 10 may further include a coolant supply 50 in communication with at least one aperture 51 in the shell 26, optionally wherein the aperture comprises a conduit 53, such as a pipe, which proceeds through the aperture in the shell 26. (In an alternative/additional embodiment (not shown), the coolant supply may provide coolant between the impingement plate 34 and the conveyor 22, just above the item(s) 38.) The shell 26 may comprise a top 52, opposed edges 54, 56 and opposed side walls 58, 60, with the lower edges 27 supporting the impinger 28.

FIGS. 2 through 5 depict illustrative designs of the cam 40 (*a-d*) shown in FIG. 1. As shown in FIGS. 2 through 5, each of the at least one cam 40 may independently comprise one lobe 40*a*, two lobes 40*b*, three lobes 40*c*, or six lobes 40*d*, respectively. In certain embodiments, each of the cams 40*a*-40*d* may independently comprise any number of lobes desired to achieve any frequency and/or amplitude required of a particular application. The cams shown in FIGS. 2 through 5 are merely illustrative embodiments of particular cam designs which may be used with the apparatus described herein. While it may be desirable for all of the at least one cams used in a particular application to have the same design, it may also be desirable for each of the at least one cams to have different designs in other applications, depending on the desired result.

In a first embodiment, provided is a subject impingement apparatus associated with a conveyor, the impingement apparatus comprising: (a) a shell supporting an impinger; and (b) a coolant delivery apparatus enclosed within the shell, the coolant delivery apparatus comprising a gas circulation device for directing a coolant to the impinger; the impinger comprising: (i) an impingement plate comprising openings for directing impingement jets toward the conveyor; (ii) at least one non-circular cam in mechanical communication with the at least one conveyor and rotatable when the conveyor is in motion; and (iii) at least one connector in mechanical communication with the at least one cam and the impingement plate, the connector displaceable during rotation of the at least one cam to elevate and lower the impingement plate.

The impingement apparatus of the first embodiment may include that the shell comprises a top, opposed edges and opposed side walls supporting the impinger.

The impingement apparatus of either of the first or subsequent embodiments may further include that the impingement plate comprises: a plurality of holes in the impingement plate, through which the impingement jets are directed; or open, elongated channels constructed and arranged between a plurality of rails forming the impingement plate, through which the impingement jets are directed.

The impingement apparatus of any of the first or subsequent embodiments may further include that the gas circulation device may be selected from the group consisting of an impeller, a blower and an axial flow fan.

The impingement apparatus of any of the first or subsequent embodiments may further include that the impingement apparatus is mounted in a food freezer.

The impingement apparatus of any of the first or subsequent embodiments may further include that the at least one non-circular cam may comprise a plurality of lobes.

In a second embodiment provided is a subject apparatus for cooling or freezing items comprising: a housing comprising a ceiling, a floor and side walls defining a chamber within the housing; at least one conveyer extending into the chamber between the ceiling and the floor; and at least one impingement apparatus disposed in the chamber and above the conveyor; the impingement apparatus comprising: (a) a shell supporting an impinger; and (b) a coolant delivery apparatus enclosed within the shell, the coolant delivery apparatus comprising a gas circulation device for directing a coolant to the impinger; the impinger comprising: (i) an impingement plate comprising openings for directing impingement jets toward the conveyor; (ii) at least one non-circular cam in mechanical communication with the at least one conveyor and rotatable when the conveyor is in motion; and (iii) at least one connector in mechanical communication with the cam and the impingement plate, the connector displaceable during rotation of the at least one cam to elevate and lower the impingement plate.

The apparatus of the second embodiment may further comprise a coolant supply in communication with the coolant delivery apparatus.

The apparatus of either of the second or subsequent embodiments may further include that the shell comprises a top, opposed edges and opposed side walls supporting the impinger.

The apparatus of any one of the second or subsequent embodiments may further include that the impingement plate comprises: a plurality of holes in the impingement plate, through which the impingement jets are directed; or open, elongated channels constructed and arranged between a plurality of rails forming the impingement plate, through which the impingement jets are directed.

The apparatus of any one of the second or subsequent embodiments may further include that the gas circulation device may be selected from the group consisting of an impeller, a blower, and an axial flow fan.

The apparatus of any one of the second or subsequent embodiments may further include that the apparatus is mounted in a food freezer.

The apparatus of any one of the second or subsequent embodiments may further comprise a plurality of modules within the housing chamber, each one of the plurality of modules including at least one impingement apparatus associated with the conveyor.

The apparatus of any one of the second or subsequent embodiments may further include that the at least one non-circular cam may comprise a plurality of lobes.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. An impingement apparatus associated with a conveyor, the impingement apparatus comprising:

(a) a shell disposed at an interior of the impingement apparatus, the shell supporting an impinger above the conveyor; and (b) a coolant delivery apparatus selected from the group consisting of an impeller, a blower, and an axial flow fan and being enclosed within the shell for directing a cryogen coolant to the impinger, the impinger comprising:

(i) an impingement plate comprising openings for directing impingement jets toward the conveyor, (ii) at least one non-circular cam in mechanical communication with the conveyor for transfer of linear motion of the conveyor into rotary motion of the at least one non-circular cam, and (iii) at least one connector in mechanical communication with the at least one non-circular cam and the impingement plate, the at least one connector comprising a vertical plate engaged with the impingement plate and resting on the non-circular cam for being displaceable during the rotary motion of the at least one non-circular cam to elevate and lower the impingement plate to create an impact force on the impingement plate.

2. The impingement apparatus of claim 1, wherein the shell comprises a top, opposed edges and opposed side walls supporting the impinger.

3. The impingement apparatus of claim 1, wherein the impingement plate comprises a plurality of holes in the impingement plate through which the impingement jets are directed.

4. The impingement apparatus of claim 1, wherein the impingement plate comprises open, elongated channels constructed and arranged between a plurality of rails forming the impingement plate, and through which the impingement jets are directed.

5. The impingement apparatus of claim 1, wherein the impingement apparatus is mounted in a food freezer.

6. The impingement apparatus of claim 1, wherein the at least one non-circular cam comprises a plurality of lobes.

7. An apparatus for cooling or freezing items, comprising:

a housing comprising a ceiling, a floor and side walls defining a chamber within the housing;

at least one conveyer extending into the chamber between the ceiling and the floor; and at least one impingement apparatus disposed in the chamber and above the conveyor, the impingement apparatus comprising:

(a) a shell supporting an impinger above the conveyor; and (b) a coolant delivery apparatus selected from the group consisting of an impeller, a blower, and an axial flow fan and being enclosed within the shell for directing a cryogen coolant to the impinger, the impinger comprising:

(i) an impingement plate comprising openings for directing impingement jets toward the conveyor, (ii) at least one non-circular cam in mechanical communication with the conveyor for transfer of linear motion of the conveyor into rotary motion of the at least one non-circular cam, and (iii) at least one connector in mechanical communication with the at least one non-circular cam and the impingement plate, the at least one connector comprising a vertical plate engaged with the impingement plate and resting on the non-circular cam for being displaceable during the rotary motion of the at least one non-circular cam to elevate and lower the impingement plate to create an impact force on the impingement plate.

8. The apparatus of claim 7, further comprising a cryogen coolant supply in communication with the coolant delivery apparatus.

9. The apparatus of claim 7, wherein the shell comprises a top, opposed edges and opposed side walls supporting the impinger.

10. The apparatus of claim 7, wherein the impingement plate comprises a plurality of holes in the impingement plate through which the impingement jets are directed.

11. The apparatus of claim 7, wherein the impingement plate comprises open, elongated channels constructed and arranged between a plurality of rails forming the impingement plate, and through which the impingement jets are directed.

12. The apparatus of claim 7, wherein the apparatus is mounted in a food freezer.

13. The apparatus of claim 7, further comprising a plurality of modules within the chamber of the housing, each one of the plurality of modules including at least one impingement apparatus associated with the conveyor.

14. The apparatus of claim 7, wherein the at least one non-circular cam comprises a plurality of lobes.

* * * * *